United States Patent [19]

Apple

[11] 4,103,508

[45] Aug. 1, 1978

[54] METHOD AND APPARATUS FOR CONDITIONING AIR

[76] Inventor: Hugh C. Apple, 2023 Lynwood Dr., Greensboro, N.C. 27406

[21] Appl. No.: 765,746

[22] Filed: Feb. 4, 1977

[51] Int. Cl.[2] ..... F25D 17/06; F25D 23/00; F24F 3/14; B01F 3/02

[52] U.S. Cl. ..... 62/92; 62/271; 165/20; 236/44 R

[58] Field of Search ..... 165/20, 27, 30, 59; 236/44 R; 261/151; 62/92, 171

[56] References Cited

U.S. PATENT DOCUMENTS

| | | | |
|---|---|---|---|
| Re. 17,998 | 3/1931 | Fleisher | 62/92 |
| 1,670,656 | 5/1928 | Fleisher | 165/20 |
| 2,123,742 | 7/1938 | Offen | 236/44 R |
| 2,156,293 | 5/1939 | Kaufman | 62/271 |
| 2,338,382 | 1/1944 | Marlow | 236/44 R |
| 2,374,208 | 4/1945 | Jones, Jr. | 165/20 |
| 3,532,156 | 10/1970 | Berryhill | 165/20 |

*Primary Examiner*—Lloyd L. King

*Attorney, Agent, or Firm*—Bell, Seltzer, Park & Gibson

[57] ABSTRACT

A method and apparatus for providing temperature and humidity controlled air to an enclosed space within a building to achieve desired conditions of temperature and humidity therein, and which is characterized by the maximum use of the outside air for cooling purposes to thereby minimize the load on the refrigeration unit and thus also minimize the operating expense thereof. In particular, the present method and apparatus includes means for selectively positioning the outside air damper and return air damper in an air washer system such that the outside air and return air are introduced into a mixing chamber during conditions wherein the outside air has a wet bulb temperature above the dew point temperature of air at the desired conditions of temperature and humidity, and below the wet bulb temperature of air at the desired conditions of temperature and humidity, with the return air being introduced in a quantity only sufficient to provide sufficient heat to maintain the continuous operation of the refrigeration unit.

12 Claims, 3 Drawing Figures

METHOD AND APPARATUS FOR CONDITIONING AIR

Figure 1:
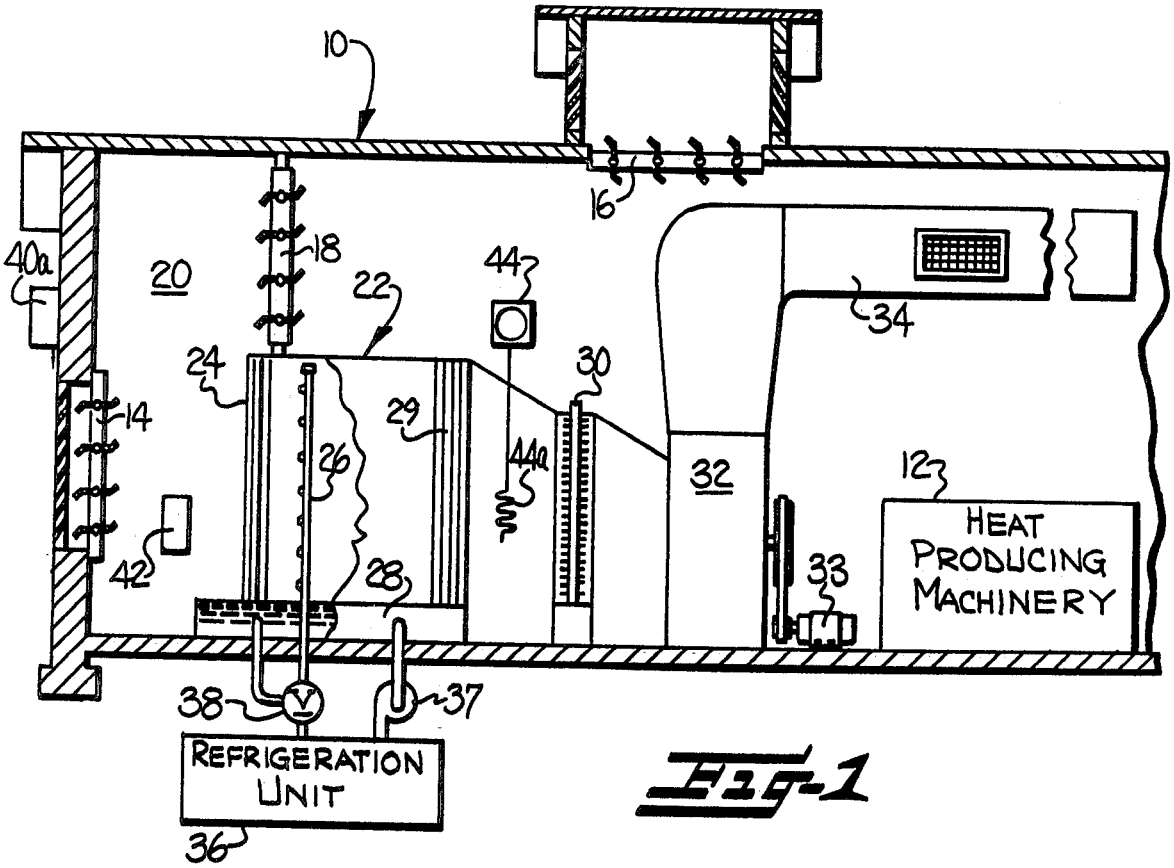

The present invention relates to an air conditioning control system for providing temperature and humidity controlled air to an enclosed space.

Various air conditioning systems are presently in use which are designed to provide close temperature and humidity control for an enclosed space, such as an auditorium or manufacturing plant. For example, it has long been recognized that a proper temperature and adequate humidity are essential in a textile mill in order to lessen static electricity and fly in the yarn being processed, and to reduce yarn breakage.

In a typical air conditioning system of the type conventionally used, for example, in textile mills, outside air is passed through an air washer, where water is sprayed into the moving air stream to substantially saturate the air. A pump recirculates the water through the washer, and a refrigeration unit is employed to chill the water when the evaporative cooling in the washer is not able to handle the heat load generated by the machinery in the room being conditioned. Eliminator blades are mounted downstream of the washer for removing entrained water droplets and any lint in the air stream which is not removed in the washer. Further, heating means may be mounted downstream of the eliminator blades for adding heat to the air stream under winter conditions and where the machinery heat is inadequate to maintain the desired room temperature. A fan and duct system is employed to circulate the air through the room, and the air is then either exhausted to the outside through a relief damper, or returned through a return air damper to a mixing chamber positioned immediately upstream of the air washer where the return air is mixed with the incoming outside air.

During winter operation of the above-described conventional apparatus, the return air and outside air are mixed under the control of a dew point thermostat positioned downstream of the eliminator blades so that the wet bulb temperature of the mixed air will approximately equal the dew point temperature of air at the desired condition of temperature and humidity in the room being conditioned. When the wet bulb temperature of the outside air reaches this critical dew point temperature, the outside air damper is moved from a substantially fully open position to a fully closed position, the return air damper is fully opened, and the refrigeration unit of the washer is activated. Thus the entire cooling load is transferred from the outside air to the refrigeration unit when the outside air reaches the critical dew point temperature, and such conditions are maintained when the outside air is at any temperature above the critical dew point temperature.

It will be recognized that outside air at the above defined critical dew point temperature has a total heat or enthalpy below that of air at the desired conditions of temperature and humidity in the room, and that in the conventional air conditioning system as described above, the cooling potential of the outside air resulting from this lower enthalpy level is lost when the outside air is between the critical dew point temperature and a wet bulb temperature corresponding to that of air at the desired conditions of temperature and humidity. The reason for the fact that the designers of conventional systems have been willing to lose this cooling potential arises from the fact that most systems employ a refrigeration unit of large capacity, for example 900 to 1,000 tons, and when the outside air has a wet bulb temperature immediately above the critical dew point temperature, very little cooling of the outside air is required in the air washer to reduce the enthalpy thereof to that of air at the critical dew point temperature. Such large refrigeration units are unable to supply this limited cooling, even at minimum settings, and thus the unit would have to be cyclically operated to effectively limit its output. Cyclical operation of the refrigeration unit is unsatisfactory however, since it results in accelerated wear in the unit, and a significant cooling off period is required after the unit is stopped and before it can be restarted, thereby rendering it difficult to control the temperature of the chilled water. Thus in the prior systems, the problem of supplying limited cooling capacity at or immediately above the dew point temperature has been avoided by simply closing the outside air damper and opening the return air damper, such that the refrigeration unit immediately supplies the entire cooling load and so that it can be continuously run at a relatively high load setting so as to avoid cycling. However, as noted above, this "solution" is at a cost of losing the cooling potential of the outside air when the outside air is between the critical dew point temperature and a wet bulb temperature of air at the desired conditions of temperature and humidity. In practical terms, this lost cooling potential results in a substantially increased operating cost for the refrigeration unit.

It is accordingly an object of the present invention to provide a method and apparatus for providing temperature and humidity controlled air to an enclosed space and which makes efficient use of the cooling capacity of the outside air to thereby minimize the load and operating expense of the refrigeration unit.

It is another object of the present invention to provide a method and apparatus for providing temperature and humidity controlled air to an enclosed space which utilizes the cooling capacity of the outside air until the total heat or enthalpy of the outside air equals or is greater than the enthalpy of air at the desired conditions of temperature and humidity within the enclosure being conditioned.

It is a further object of the present invention to provide a highly efficient air conditioning system of the described type, to which an existing conventional air conditioning system having a refrigeration unit of relatively large capacity may be readily converted.

These and other objects and advantages of the present invention are achieved in the embodiment illustrated herein by the provision of a method and apparatus for providing temperature and humidity controlled air to an enclosed space and wherein outside air and return air are introduced into a mixing chamber positioned upstream of the air washer in proportions wherein the return air provides a predetermined amount of heat (or BTU's) during conditions wherein the outside air has a wet bulb temperature above the dew point temperature of air at the desired conditions of temperature and humidity, and below the wet bulb temperature of air at the desired conditions of temperature and humidity. By design, the return air is introduced in a quantity only sufficient to maintain the continuous operation of the refrigeration unit. Thus maximum use is made of the cooling potential of the outside air within this temperature range.

In a typical installation, the return air is introduced into the mixing chamber only when the outside air has a wet bulb temperature in a predetermined range up to about 3° F. immediately above the critical dew point temperature. When the outside air has a wet bulb temperature between the highest temperature in such range and the wet bulb temperature of air at the desired conditions of temperature and humidity, only outside air is introduced into the mixing chamber since the outside air then contains sufficient heat to maintain the continuous operation of the refrigeration unit. When the outside air is above this upper or maximum wet bulb temperature, only return air is introduced into the mixing chamber since the outside air is no longer able to contribute to the cooling load.

Figure 2:
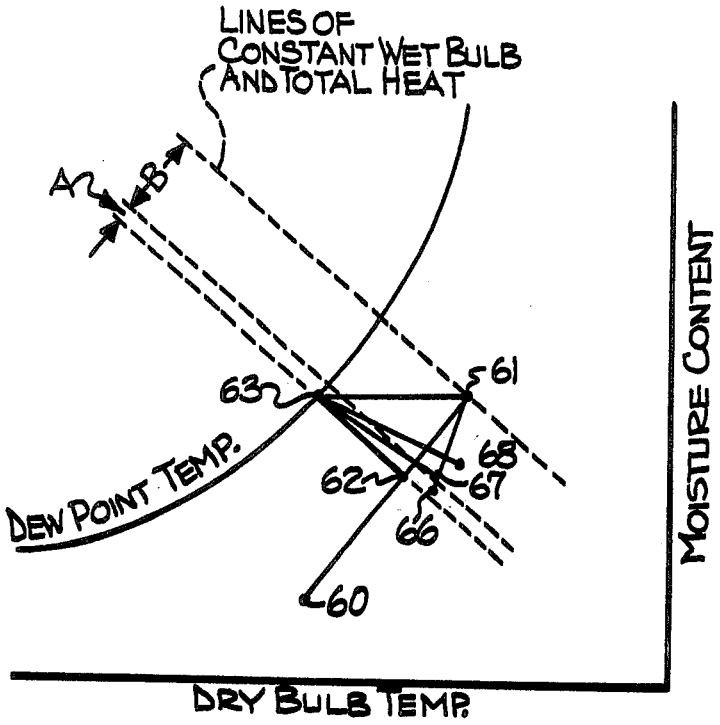
Figure 3:
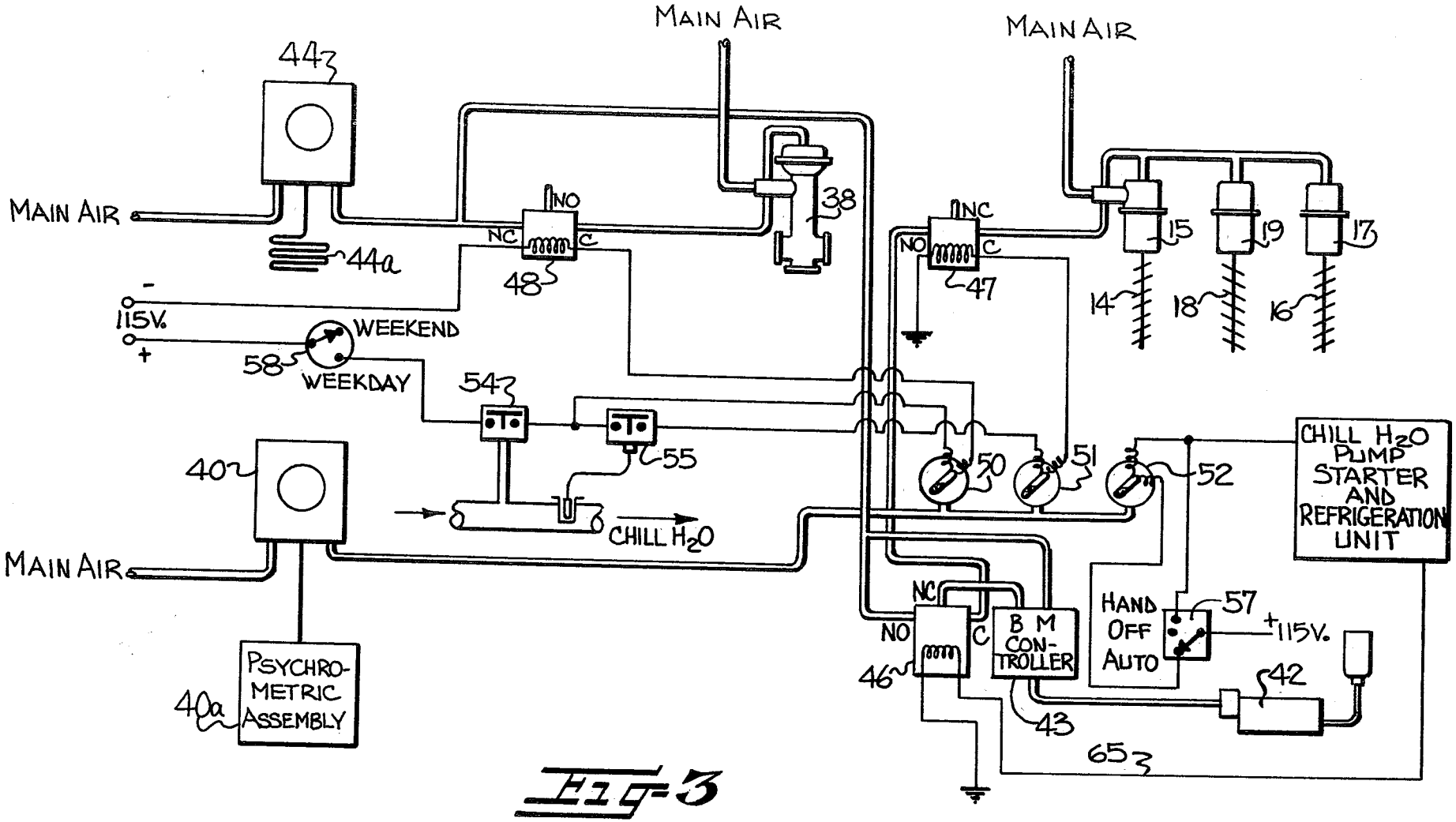

Some of the objects having been stated, other objects will appear as the description proceeds, when taken in connection with the accompanying drawings in which FIG. 1 is a schematic representation of an air conditioning apparatus embodying the present invention;

FIG. 2 is a psychrometric chart illustrating the operation of the present invention under various conditions of the outside air; and FIG. 3 is a schematic representation of one embodiment of a control system for the air conditioning apparatus of FIG. 1.

Referring more specifically to the drawings, FIG. 1 schematically illustrates an air conditioning apparatus embodying the present invention, and which is designed to provide temperature and humidity controlled air to the interior of the building 10. Typically, the building 10 is a manufacturing plant, such as a textile mill, and contains heat producing machinery 12.

The building 10 has an outside air damper 14 which is controlled by the pneumatic valve 15, and a relief air damper 16 controlled by the valve 17. Also, the area immediately inside the building and adjacent the outside air damper comprises a closed air space or mixing chamber 20, which is operatively connected to the inside of the building by means of the return air damper 18. The damper 18 is similarly controlled by a pneumatic valve 19.

An air washer is positioned adjacent the outside air damper 14, and is generally indicated at 22. More particularly, the washer includes an inlet baffle 24 communicating with the chamber 20, water spray nozzles 26, a water tray 28, and eliminator blades 29. A heater 30 may be positioned downstream of the eliminator blades, and a fan 32 and associated motor 33 are employed for drawing the air through the washer from the mixing chamber 20, and conveying the same through the discharge duct 34 into the interior of the building. A refrigeration unit 36 is operatively connected to the water system of the air washer by means of a pump 37 and chill water valve 38. Typically, the refrigeration unit 36 is of relatively large capacity, for example about 900 to 1,000 tons.

To control the operation of the various dampers, and the refrigeration unit of the washer, there is provided a wet bulb/dry bulb recording controller 40 of the conventional design and which is operatively connected to a conventional psychrometric assembly (with a fan) **40*a* positioned outside the building for monitoring the condition of the outside air. As will become apparent, the dry bulb portion of the controller 40 is utilized for record purposes only, and only the wet bulb portion is utilized in the actual control of the apparatus. The apparatus further includes a conventional psychrometric assembly (without fan) 42 positioned within the mixing chamber 20 and which is operatively connected to the pneumatically operated controller 43. The controller 43 is also itself conventional, and is adapted to control the pressure passing through the terminals M and B in accordance with a predetermined temperature setting. Further, the apparatus includes a conventional dew point controller 44 which is operatively connected to an elongate averaging element or tube 44*a* positioned downstream of the eliminator blades 29** in the washer.

As seen in FIG. 3, the controller 44 is operatively connected via a pneumatic line which leads through the normally open ports of the electric-pneumatic (EP) switches 46 and 47, and to each of the valves 15, 17, 19 for the three dampers. Also, the controller 44 is selectively connected to the chill water valve 38 when the EP switch 48 is closed.

The controller 40 is operatively connected to three pneumatic-electric (PE) switches 50, 51 and 52, with the switch 50 controlling the EP switch 48, and the switch 51 controlling the EP switch 47. The third switch 52 initiates an automatic sequence for starting the refrigeration unit 36, and wherein the chill water pump 37 is initially energized, the refrigeration unit is subsequently started when the water is flowing. The PE switches 50 and 51 are also effectively controlled by means of the pump pressure switch 54 and damper changeover switch 55 as hereinafter further described. Also, the PE switch 52 is controlled by the switch 57 to permit manual control of the operation of the refrigeration unit, and a weekend-weekday switch 58 may be provided for shutting down the apparatus during periods of non-use of the factory.

To describe the operation of the apparatus, it will initially be assumed that the apparatus is operating under winter conditions and with the outside air being at point 60 on the psychrometric chart shown in FIG. 2. In this regard, it will also be assumed that the desired conditions of temperature and humidity in the building are represented at point 61 on the chart. Under these conditions, the controller 44 will operate through the EP switches 46 and 47 to position the dampers 14, 16 and 18 in accordance with a predetermined program. More particularly, the dampers are positioned to permit the outside air and return air to be introduced into the mixing chamber 20 in proportions such that the wet bulb temperature of the mixed air (represented at point 62 in FIG. 2) approximately equals the dew point temperature (i.e., point 63) of air at the desired condition of temperature and humidity (i.e., point 61). The air in the mixing chamber 20 is drawn through the air washer 22 by the fan 32, where it undergoes adiabatic saturation to arrive at the point 63 in FIG. 2. Finally, the air is conveyed into the interior of the building, where it is heated by the machinery 12 to arrive at the desired point 61. If the machinery 12 is unable to adequately heat the air, the heater 30 may be energized to provide the required additional heat.

When the temperature of the outside air rises to a point where its wet bulb temperature equals the dew point temperature at point 63 in FIG. 2, the controller 40 closes PE switches 50 and 52. Switch 52 starts the chilled water pump 37, and as the pump pressure rises to a predetermined level, the refrigeration unit 36 is energized. Also, the pump pressure switch 54 is closed to permit current to flow through the switch 50 to the EP switch 48. Thus, the controller 44 becomes operatively connected to the chill water valve 38.

Concurrently with the starting of the refrigeration unit 36, the switch 46 is activated by a signal through the line 65, such that the controller 43 is brought onto line to control the setting of the dampers 14, 16 and 18. In this regard, the controller 43 is programmed to mix the outside air and return air in proportions wherein the return air provides a predetermined amount of total heat (or BTU's) which, by design, imposes a minimum load on the refrigeration unit 36 and permits it to operate continuously and without cycling. Stated in other words, the controller 43 is set at a temperature a sufficient number of degrees above the dew point temperature (typically 2 or 3° above) such that the pounds of air moving through the washer will contain sufficient BTU's to equal the minimum load for the refrigeration unit 36. Thus the psychrometric assembly 42 and controller 43 sense the total heat in the moving air, compare it with the required minimum cooling load, and adjustably position the dampers in response to a difference between the sensed total heat and required minimum load.

The controller 44 is programmed to regulate the valve 38 so as to achieve a setting consistent with the objective of maintaining the operation of the refrigeration unit. In this regard, the controller 44 attempts to maintain the temperature of the air as constant as possible, and when the controller 43 comes onto line, the controller 43 limits the outside air which is being brought into the mixing chamber 20 for the purpose of preventing cycling of the refrigeration unit as noted above. Thus the controller 44 can no longer utilize the dampers to control the temperature, but rather now utilizes its control of the chill water valve 38 for this purpose.

The introduction of return air into the mixing chamber 20 is normally required within a wet bulb temperature range (indicated at A in FIG. 2) up to about 3° F. immediately above the dew point temperature (point 63). The exact extent of the range varies from installation to installation, and is dependent upon a number of conditions, including the size of the refrigeration unit, and the size of the enclosure being conditioned. Thus for example, when the outside air is within the range A and as represented at point 66 in FIG. 2, the outside air and return air are mixed so that the resulting mixed air will be represented by point 67. After saturation and cooling in the air washer, the mixed air will be brought to the condition of point 63 where it may be introduced into the interior of the building and heated to reach the desired condition 61. As the outside wet bulb temperature rises through the range A, the outside damper 14 is increasingly opened and the return air damper 18 is increasingly closed by the controller 43, and when the wet bulb temperature of the outside air reaches the upper limit of the range A, the controller 43 will have acted to fully open the outside air damper 14 and close the return air damper 18.

When the outside air has a wet bulb temperature above the range A and below the wet bulb temperature at condition 61 (i.e., within the range B shown in FIG. 2), the outside air is alone able to provide sufficient heat to maintain the continuous operation of the refrigeration unit, and the outside air damper 14 remains fully open. The outside air is thereby able to substantially contribute to the cooling load in the building throughout both temperature ranges A and B, thereby reducing the energy consumption of the refrigeration unit 36. A representative condition of outside air within the range B is indicated at point 68 in FIG. 2, it being understood that this air will be saturated and cooled in the washer 22 to reach point 63.

When the wet bulb temperature of the outside air reaches that of the air at the desired conditions of temperatures and humidity (i.e., point 61), it will be apparent that the outside air can no longer contribute to the cooling load within the building. Accordingly, at this point the controller 40 closes the switch 51, which in turn activates the EP switch 47 to thereby close the outside air damper 14 and relief damper 16, and open the return air damper 18. In this regard, the switch 55, which is controlled by a bulb in the chill water line, acts to limit the closing of switch 51 to conditions wherein the chill water is at a predetermined temperature. Should the temperature of the outside air subsequently drop into the range B, the above described sequence is merely repeated in reverse order.

From the above description, it will be apparent that the outside air is utilized to its maximum degree of cooling capacity, and while avoiding the undesirable cycling of the refrigeration unit. Further, the refrigeration unit is used only when needed to assure the desired conditions of temperature and humidity, and the heat required to maintain the operation of the refrigeration unit is obtained from a source (i.e., the return air) which is normally lost, and thus no input of energy into the system is required for this purpose. Also, the present invention achieves a smooth changeover from summer to winter conditions, and vice versa.

In the drawings and specification, there has been set forth a preferred embodiment of the invention, and although specific terms are employed, they are used in a generic and descriptive sense only and not for purposes of limitation.

That which is claimed is:

1. A method for providing temperature and humidity controlled air to an enclosed space to achieve desired conditions of temperature and humidity therein, and which is characterized by the maximum use of the outside air for cooling purposes to thereby minimize the load on the refrigeration unit and while insuring a predetermined minimum load on the refrigeration unit during periods of its operation to thereby avoid undesirable cycling of the unit, and comprising (a) during conditions wherein the outside air has a wet bulb temperature in a predetermined range immediately above the dew point temperature of air at the desired conditions of temperature and humidity, the steps of:

(1) introducing outside air and return air from the enclosed space into a mixing chamber, (2) conveying the air from the mixing chamber through an air washer while cooling the same with a refrigeration unit to an extent such that the wet bulb temperature of the mixed air approximately equals the dew point temperature of air at the desired conditions of temperature and humidity, (3) controlling the proportions of the outside air and return air being introduced into the mixing chamber such that the total heat of the mixed air is only sufficient to permit the continuous operation of the refrigeration unit in cooling the mixed air as recited in step 2, and (4) conveying the mixed and saturated air resulting from steps 1–3 into the enclosed space, and (b) during conditions wherein the outside air has a wet bulb temperature between the highest temperature in said predetermined range and the wet bulb temperature of air at the desired conditions of temperature and humidity, the steps of:

(5) introducing substantially only outside air into the mixing chamber, (6) conveying the air from the mixing chamber through the air washer while saturating the mixed air and cooling the same with the refrigeration unit to an extent such that the wet bulb temperature thereof approximately equals the dew point temperature of air at the desired conditions of temperature and humidity, and (7) conveying the mixed and saturated air resulting from steps 5–6 into the enclosed space.

2. The method as defined in claim 1 wherein step 3 includes sensing the wet bulb temperature of the air passing through the mixing chamber.

3. The method as defined in claim 2 wherein step 6 includes regulating the output of the refrigeration unit to maintain a predetermined dew point temperature for the air leaving the air washer.

4. A method of providing temperature and humidity controlled air to an enclosed space to achieve desired conditions of temperature and humidity therein, and which is characterized by the maximum use of the outside air for cooling purposes to thereby minimize the load on the refrigeration unit and while insuring a predetermined minimum load on the refrigeration unit during periods of its operation to thereby avoid undesirable cycling of the unit, and comprising the steps of (1) monitoring the wet bulb temperature of the outside air, (2) introducing outside air and return air from the enclosed space into a mixing chamber in proportions such that the wet bulb temperature of the mixed air approximately equals the dew point temperature of air at the desired conditions of temperature and humidity, during conditions wherein the outside air has a wet bulb temperature below such dew point temperature, while (3) saturating the mixed air resulting from step 2, and while (4) conveying the mixed and saturated air resulting from steps 2 and 3 into the enclosed space, (5) introducing outside air and return air from the enclosed space into the mixing chamber in proportions wherein the return air provides a predetermined amount of heat, during conditions wherein the outside air has a wet bulb temperature in a predetermined range up to about 3° F. immediately above such dew point temperature, while (6) saturating the mixed air resulting from step 5 and cooling the same to an extent such that the wet bulb temperature thereof approximately equals such dew point temperature, while (7) conveying the mixed and saturated air resulting from step 6 into the enclosed space, (8) introducing substantially only outside air into the mixing chamber during conditions wherein the outside air has a wet bulb temperature between the highest temperature in said range and the wet bulb temperature of air at the desired conditions of temperature and humidity, while (9) saturating the mixed air resulting from step 8 and cooling the same to an extent such that the wet bulb temperature thereof approximately equals such dew point temperature, while

(10) conveying the mixed and saturated air resulting from step 9 into the enclosed space.

5. An apparatus for providing temperature and humidity controlled air to an enclosed space within a building to achieve desired conditions of temperature and humidity therein, and which comprises a mixing chamber positioned within the building and having an outlet opening, outside air damper means for selectively admitting outside air into said mixing chamber, return air damper means for selectively admitting return air from the interior of the building into said mixing chamber, relief air damper means for selectively permitting air within the building to exhaust to the outside, an air washer operatively connected to the outlet opening of said mixing chamber, said air washer including a water circulation system and a refrigeration unit for cooling the water in said circulation system, and fan means for drawing air though said mixing chamber and air washer and distributing the same into said enclosed space, the improvement therein comprising means for selectively controlling the positioning of said outside air and return air damper means such that outside air and return air are introduced into said mixing chamber during conditions wherein the outside air has a wet bulb temperature above the dew point temperature of air at the desired conditions of temperature and humidity and below the wet bulb temperature of air at the desired conditions of temperature and humidity, with the return air being introduced in a quantity only sufficient to maintain the continuous operation of said refrigeration unit.

6. The apparatus as defined in claim 5 wherein said controlling means comprises means for sensing the total heat in the air passing through said mixing chamber, and for comparing the sensed total heat with the minimum load required to maintain the continuous operation of said refrigeration unit.

7. The apparatus as defined in claim 6 wherein said controlling means further comprises means operatively connected to said comparing means for adjustably positioning each of said damper means in response to a difference between the sensed total heat and required minimum load.

8. The apparatus as defined in claim 7 further comprising means for rendering said controlling means operative only under conditions wherein the outside air has a wet bulb temperature within the range between a wet bulb temperature corresponding to the dew point temperature of air at the desired conditions of temperature and humidity and a wet bulb temperature corresponding to that of air at the desired conditions of temperature and humidity.

9. The apparatus as defined in claim 8 wherein said means for rendering said controlling means operative, comprises a wet bulb controller positioned to monitor the outside air.

10. The apparatus as defined in claim 9 further comprising means for actuating said refrigeration unit when the outside air has a wet bulb temperature above the dew point temperature of air at the desired conditions of temperature and humidity.

11. The apparatus as defined in claim 10 further comprising valve means positioned in said water circulation system, and means for regulating said valve means to control the output of said refrigeration unit.

12. The apparatus as defined in claim 11 wherein said means for regulating said valve means comprises means positioned downstream of said air washer for sensing the dew point temperature of the air at such point.

* * * * *